United States Patent [19]

Waples

[11] Patent Number: 4,580,833

[45] Date of Patent: Apr. 8, 1986

[54] SAFETY LOCK FOR A FOLDING HIGH CHAIR

[75] Inventor: David G. Waples, East Aurora, N.Y.

[73] Assignee: The Quaker Oats Company, Chicago, Ill.

[21] Appl. No.: 672,284

[22] Filed: Nov. 16, 1984

[51] Int. Cl.[4] ..... A47C 4/00

[52] U.S. Cl. ..... 297/39; 297/47; 297/30

[58] Field of Search ..... 297/39, 35, 47, 46, 297/48, 148, 30

[56] References Cited

U.S. PATENT DOCUMENTS

| | | | |
|---|---|---|---|
| 262,311 | 8/1882 | Ortlepp | 297/30 |
| 1,727,115 | 9/1929 | Rastetter | 297/48 |
| 2,005,715 | 6/1935 | Kovats | 297/47 |
| 2,714,921 | 8/1955 | Rechler | 297/30 |
| 2,851,086 | 9/1958 | Weiner | 297/39 |
| 3,086,812 | 4/1963 | Eads | 297/30 |
| 3,319,997 | 5/1967 | Clement | 297/39 |
| 3,715,142 | 2/1973 | Lay et al. | 297/39 |

*Primary Examiner*—Francis K. Zugel

*Attorney, Agent, or Firm*—Cumpston & Shaw

[57] ABSTRACT

An improved folding high chair is disclosed of the type movable between a collapsed position for storage and an upright locked position for use by a child. The chair has a safety mechanism to prevent collapse of the chair while occupied by a child. Momentary release of the chair from its upright locked position while occupied by a child could cause rapid collapse of the chair resulting in possible discomfort and/or injury to the child.

3 Claims, 5 Drawing Figures

SAFETY LOCK FOR A FOLDING HIGH CHAIR

BACKGROUND OF THE INVENTION

1. Field of the Invention

This invention relates generally to high chairs for children, and more particularly to a folding high chair having a safety lock for preventing movement of the chair from a locked upright position to a substantially collapsed position when the lock is momentarily released.

2. Description of the Prior Art

It is known in the prior art to provide folding strollers or the like with a locking device for releasably holding the stroller in an upright locked position for supporting a child. A disadvantage of such a stroller is that if the lock is momentarily released, the stroller will collapse, resulting in possible injury to a child occupying the stroller.

SUMMARY OF THE INVENTION

In accordance with a preferred embodiment of the invention, a folding high chair is disclosed of the type movable between a substantially collapsed position for storage and an upright locked position for use. The chair has seat and back support sections pivotally connected together, and lock means for releasably locking the seat and back support sections together in the upright position. The lock means further has safety means for preventing movement of the chair from its upright locked position to a substantially collapsed position in the event the lock means is momentarily moved to an unlocked position.

In another embodiment of the invention, the lock means comprises a first notch in the back support section, and a complementary lug on the seat section movable into and out of the first notch.

In a more specific embodiment of the invention, the lcok means comprises a plate on the back support section having a first upper notch. The safety means comprises a second lower notch in the plate adjacent the first notch. The second notch has a stop shoulder and a guide surface extending between the radially extending outer end of the first notch and the radially extending inner end of the shoulder. The guide surface guides the lug into engagement with the stop shoulder when the lug is momentarily retracted from the first notch, thereby preventing further substantial collapse of the chair.

The primary advantage of the improved folding chair of this invention is to prevent release and substantial collapse of the locked chair. Such collapse of the chair could result in possible injury and/or discomfort to a child occupant.

Another advantage of the improved folding high chair of this invention is to make it more difficult to release the locked chair by requiring depression of two spaced apart lock release handles, thereby minimizing the possibility of a child releasing the locked chair while it is occupied by another child.

Still another advantage of the improved folding high chair of this invention is to provide a safety feature that prevents substantial collapse of the locked chair when it is momentarily released. The safety feature is of simple design and construction, reliable and efficient in operation, and economical to manufacture.

The invention and its advantages will become more apparent from the detailed description of the invention presented below.

BRIEF DESCRIPTION OF THE DRAWINGS

In the detailed description of the invention presented below, reference is made to the accompanying drawings, in which.

DETAILED DESCRIPTION OF THE INVENTION

Figure 1:
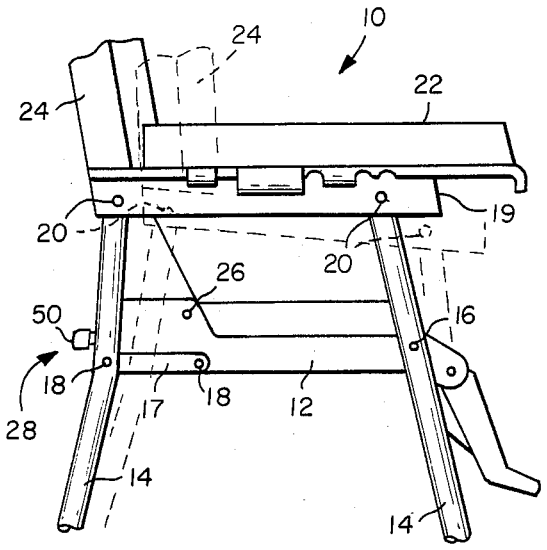
FIG. 1 is a side elevational view of a folding high chair in which a preferred embodiment of the lock means comprising the safety lock of this invention is incorporated.
Figure 2:
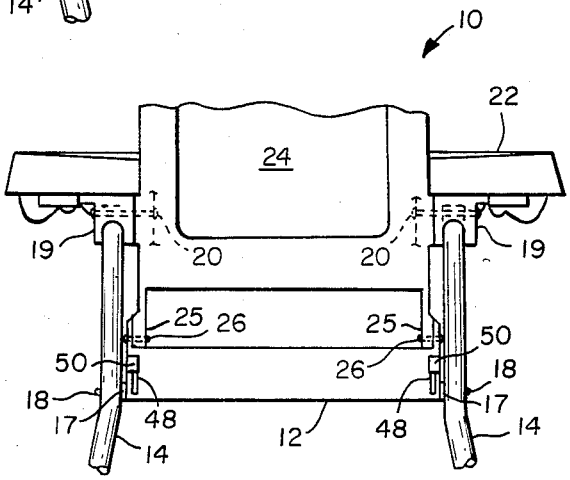
FIG. 2 is a segmental rear elevational view of the high chair of FIG. 1.

Referring now to FIGS. 1 and 2 of the drawings, a preferred embodiment of the folding high chair 10 of this invention comprises a cushioned seat section 12. The seat section is connected to intermediate portions of front legs 14 by pivot pins 16, and to intermediate portions of rear legs 14 by links 17, each link having opposite ends thereof pivotally connected to the rear leg and to the seat section by pivot pins 18. A pair of arms 19 is secured by pivot pins 20 to the upper ends of legs 14. The arms 19 slidably support an adjustably movable food receiving tray 22. The chair 10 further has a back support section 24 having flanges 25 (FIG. 2) depending from its sides at its lower end. Flanges 25 are pivotally connected to sides of the seat section 12 by pivot pins 26. The sides of the intermediate portion of back support section 24 are pivotally connected to the upper end of rear legs 14 on the aforementioned pivot pins 20. The seat section 12 and back support section 24 are pivotally movable relative to one another by virtue of pivot pins 16, 18, 20 and 26. The seat and back support sections 12, 24 respectively are further releasably secured together by lock means 28 positioned at each side of the chair, and shown in detail in FIGS. 3–5.

Figure 3:
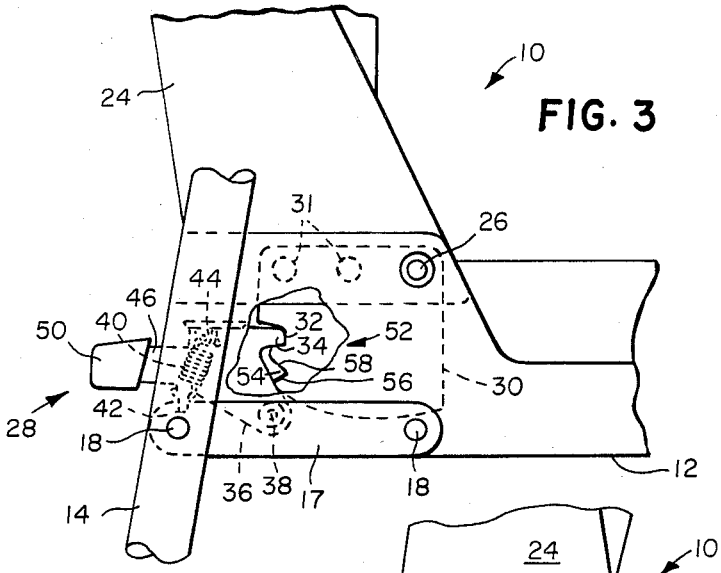
FIG. 3 is an enlarged segmental view, partially in section, of the lock means incorporated in FIG. 1.
Figure 4:
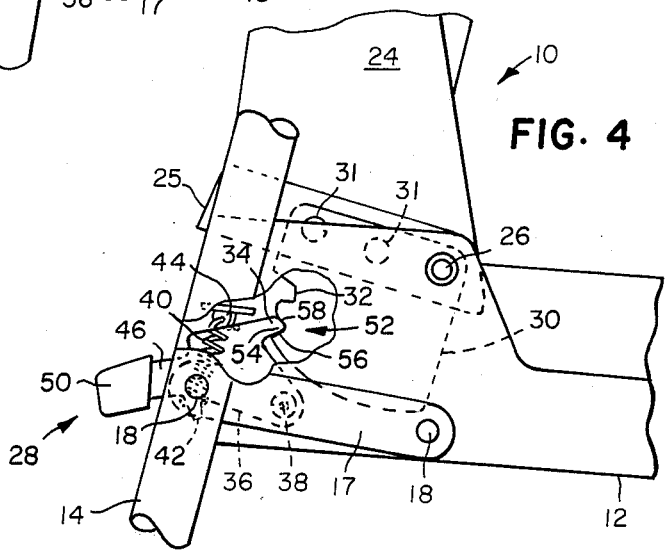
FIG. 4 is a view similar to FIG. 3 showing the safety lock engaged to prevent further collapse of the folding chair.
Figure 5:
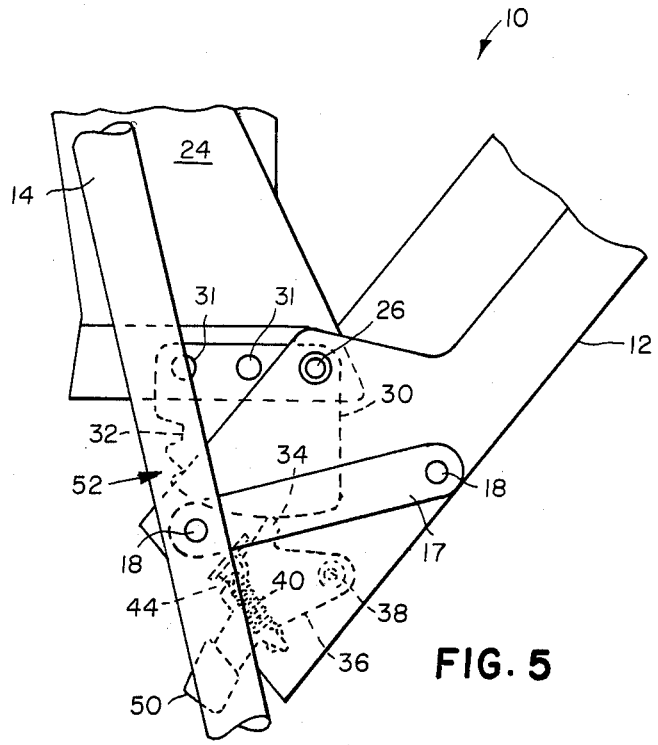
FIG. 5 is a view similar to FIGS. 3 and 4 showing the chair lock means in its fully released position allowing substantial collapse of the chair.

Since the lock means 28 on each side of the chair are identical, only one will be described in detail. In FIGS. 1 and 3, the lock means 28 is in a locked position for holding the folding chair in an upright locked position. In FIG. 5, the lock means 28 is shown in its unlocked position allowing free movement of the seat and back support sections 12, 24 respectively about pivot pins 16, 18, 20, 26, as seen in dotted lines in FIG. 1. In this unlocked position, the chair can be substantially collapsed or folded further to form a compact unit for storage.

Each lock means 28 comprises a plate 30 secured by rivets 31 to an aforementioned depending flange 25. The plate 30 has an upper peripheral notch 32 radially spaced a predetermined distance from pivot 26 for receiving a lug 34 on a release member 36. The release member is pivotally mounted on seat section 12 on pivot pin 38. Release member 36 is biased into the locked position, as best seen in FIG. 3, by a spring 40 having one end secured to a finger 42 on member 36, and its opposite end secured to a flange 44 fixed to seat section 12. Release member 36 further has an extension 46 extending through a slow 48 (FIG. 2) in seat section 12, and a handle 50 secured to extension 46. When the handle in FIG. 3 is manually depressed in a counterclockwise direction, lug 34 is withdrawn from notch 32 for releasing the lock means 28.

A safety lock means 52 for preventing movement of the chair 10 from its locked position to a substantially collapsed position will now be described. The plate 30 has a lower notch 54 adjacent upper notch 32 and radially spaced from pivot 26 a greater distance than notch 32. Lower notch 54 has a stop shoulder 56, and a curved guide surface 58 extending from the radially extending outer end of notch 32 to the radially extending inner end of shoulder 56.

If the lock means 28 at each side of the chair are released simultaneously by a child, for example, the chair will begin to collapse due to its weight causing handles 50 to move outwardly away from the child. Such movement causes the manual pressure on the handles to decrease resulting in a momentary release of the lock means. This allows springs 40 to move members 36 in a clockwise direction causing lugs 34 to move into engagement with and follow guide surfaces 58. Upon further infinitesimal collapse of the chair, guide surfaces 58 will guide the lugs into engagement with stop shoulders 56, preventing any further collapse of the chair. This is of particular importance in a situation where a child is occupying the chair and another child momentarily depresses the handles 50. In such a situation, the safety lock 52 prevents substantial collapse of the chair, thereby eliminating any possible injury to the child occupying the chair. Also, the location of lock means 28 of each side of chair 10 requires anyone releasing the chair to use both hands to depress handles 50. This decreases the possibility of a small child releasing the chair while it is is occupied by another child.

While a preferred embodiment of the invention has been shown and described with particularity, it will be appreciated that various changes and modifications may suggest themselves to one having ordinary skill in the art upon being apprised of the present invention. It is intended to encompass all such changes and modifications as fall within the scope and spirit of the appended claims.

What is claimed is:

1. An improved folding high chair of the type movable between a substantially collapsed position for storage and an upright locked position for use, comprising in combination:

a plurality of chair legs;

a seat section pivotally connected to said chair legs;

a back support section pivotally coupled to said seat section for pivotal movement about a pivot; lock means comprising a plate on said back support section having a first notch radially spaced a predtermined distance from said pivot; and safety means comprising a second notch in said plate adjacent said first notch and radially spaced a greater distance than said predetermined distance from said pivot, and said lock means further comprising a pivotal release member having a lug complementary to said first and second notches, a spring for biasing said lug toward said notches, and a handle on said release member for manually moving said lug out of engagement with said notches for moving said lock means to said unlocked position.

2. The invention according to claim 1 wherein said chair is provided with a pair of said lock means at the rear of said chair, one of said lock means being positioned on each side of said chair.

3. The invention according to claim 1 wherein said second notch has a stop shoulder engageable by said lug for preventing further collapse of the chair, and a guide surface extending from the radially extending outer end of said first notch to the radially extending inner end of said stop shoulder for guiding said spring biased lug into engagement with said stop shoulder when said lug is moved out of said first notch.

* * * * *